US005262751A

United States Patent [19]

Kudo et al.

[11] Patent Number: 5,262,751

[45] Date of Patent: Nov. 16, 1993

[54] FUSE

[75] Inventors: Toshiharu Kudo; Masahiro Kanda; Mitsuhiko Totsuka, all of Shizuoka, Japan

[73] Assignee: Yazaki Corporation, Japan

[21] Appl. No.: 987,193

[22] Filed: Dec. 8, 1992

[30] Foreign Application Priority Data

Dec. 12, 1991 [JP] Japan ..... 3-328918

[51] Int. Cl.[5] ..... H01H 85/04

[52] U.S. Cl. ..... 337/296; 337/160

[58] Field of Search ..... 337/158–166, 337/295, 296

[56] References Cited

U.S. PATENT DOCUMENTS 4,944,084 7/1990 Horibe et al. ..... 337/296

FOREIGN PATENT DOCUMENTS 55-109331 8/1980 Japan .
55-109332 8/1980 Japan .
55-117841 9/1980 Japan .
621349 1/1981 Japan .
56-18333 2/1981 Japan .
59-66844 5/1984 Japan .
59-81828 5/1984 Japan .
61-11259 1/1986 Japan .
61-66329 4/1986 Japan .
61-87439 6/1986 Japan .
1-315924 12/1989 Japan .

*Primary Examiner*—Harold Broome
*Attorney, Agent, or Firm*—Wigman, Cohen Leitner & Myers

[57] ABSTRACT

A fuse includes a meltable and conductive metal element mainly containing Cu and having a blowout portion, and a low-melting-point metal chip fixed at the blowout portion. The low-melting-point metal chip comprises a Sn-Cu alloy. Preferably, the low-melting-point metal chip comprises an alloy containing 0.5 to 3.5% by weight of Cu and all the residual content of Sn. Also preferably, the low-melting-point metal chip comprises an alloy containing 0.5 to 3.5% by weight of Cu, 1.0 to 6.0% by weight of Sb and all the residual content of Sn.

4 Claims, 3 Drawing Sheets

FUSE

BACKGROUND OF THE INVENTION

The present invention relates to a fuse, and particularly to a fuse which is applicable to a fuse link for breaking a circuit wiring provided in vehicles when an overcurrent flows through the wiring.

Generally, a fuse link for vehicles is used as a component provided in a circuit wiring around a power source of a vehicle for protecting the circuit wiring from a large amount of current to which the so-called glass-tube-type fuse can not be applied in the light of capacity. Ordinarily, the fuse link is made of a conductive material whose sectional area is smaller than that of the wire constructing the circuit wiring, and is thus effective for dead short. Incidentally, JASO-D610 provides the structure of such a fuse link.

Because the fuse link of this type can be regarded as a fuse in a broad sense, we call them "fuse" collectively hereinafter.

As a conventional fuse which is typical of the one as described above, there can be mentioned a fuse disclosed in Japanese Patent Laid Open No. 315924-1989. The fuse of this type is constructed by fixing a linear metal chip having a low melting point on a meltable and conductive metal plate (element).

The matrix of the meltable and conductive metal is an alloy of copper (Cu) which is the same as adopted in the circuit wiring. Incidentally, the Cu alloy contains Fe, P and the like component in a slight amount.

On the other hand, the material of the low-melting-point metal chip is tin (Sn) whose melting point is lower than that of Cu. Incidentally, the purity of Sn of the material is 99.5% by weight or higher.

Next, the mechanism of breaking by such a fuse is considered.

First, the chip of low-melting-point metal (Sn) is melted by an overcurrent. Then, the meltable and conductive metal element is gradually eroded by diffusion of Cu into the melted metal chip or Sn. Finally, the metal element itself is completely cut by such Cu-Sn diffusion. As the result, the breaking by this fuse can be carried out at a temperature lower than the melting point of Cu.

However, in case of such a conventional fuse, since the chip mounted on the Cu-alloy element is made of Sn having a low melting point, the fuse is likely to blow in a relatively short operating cycle regardless of the necessity.

For example, in case of opening or closing power windows of a car-door, a current about twice the rated current or in a so-called medium current range flows frequently and repeatedly in a short time period (e.g., 10 seconds) as a motor-lock current. However, the fuse must not blow in such a medium current range. Nevertheless, the Sn chip melts enough by such a current, thereby to cause the Cu-Sn diffusion as mentioned above. Therefore, the conventional fuse also blows in a relatively short operating cycle even under such a condition.

Accordingly, the durability, especially in the medium current range, is now considered to be an important problem among the blowout properties of such a fuse.

SUMMARY OF THE INVENTION

Therefore, it is an object of the present invention to provide a fuse having excellent durability against such a medium current range while guaranteeing normal blowout properties of the conventional fuse required under overcurrent conditions.

Namely, the focus of this invention is to elevate the melting point of each element, especially of the metal chip, so as to enhance the durability against temperature increase caused by the medium current as described above.

To achieve the object, the present invention provides a fuse, comprising:

- a meltable and conductive metal element mainly containing Cu and including a blowout portion; and
- a low-melting-point metal chip fixed at the blowout portion; wherein
- the low-melting-point metal chip comprises a Sn-Cu alloy.

Preferably, the low-melting-point metal chip comprises an alloy containing 0.5 to 3.5% by weight of Cu and all the residual content of Sn.

Also preferably, the low-melting-point metal chip comprises an alloy containing 0.5 to 3.5% by weight of Cu, 1.0 to 6.0% by weight of Sb and all the residual content of Sn.

Namely, according to these compositions of the fuse, since the same component Cu as the matrix of the meltable and conductive metal element is added to the low-melting-point metal chip, the diffusion of Cu from the metal element to the metal chip is suppressed under a temperature condition lower than 300° C. which corresponds to the medium current range. Therefore, the durability against the medium current is much improved as compared with the conventional fuse. In addition, since the content of Cu of the metal chip is very low, the fuse of this invention can blow immediately in the overcurrent range corresponding to a temperature condition higher than 300° C., thereby to effectively protect the circuit wiring related.

These and other objects, features and advantages of the present invention will be more apparent from the following description of a preferred embodiment, taken in conjunction with the accompanying drawings.

DESCRIPTION OF THE PREFERRED EMBODIMENT

Hereinafter, several embodiments of the fuse according to the present invention will be described with reference to the drawings.

EXAMPLE 1

Figure 1:
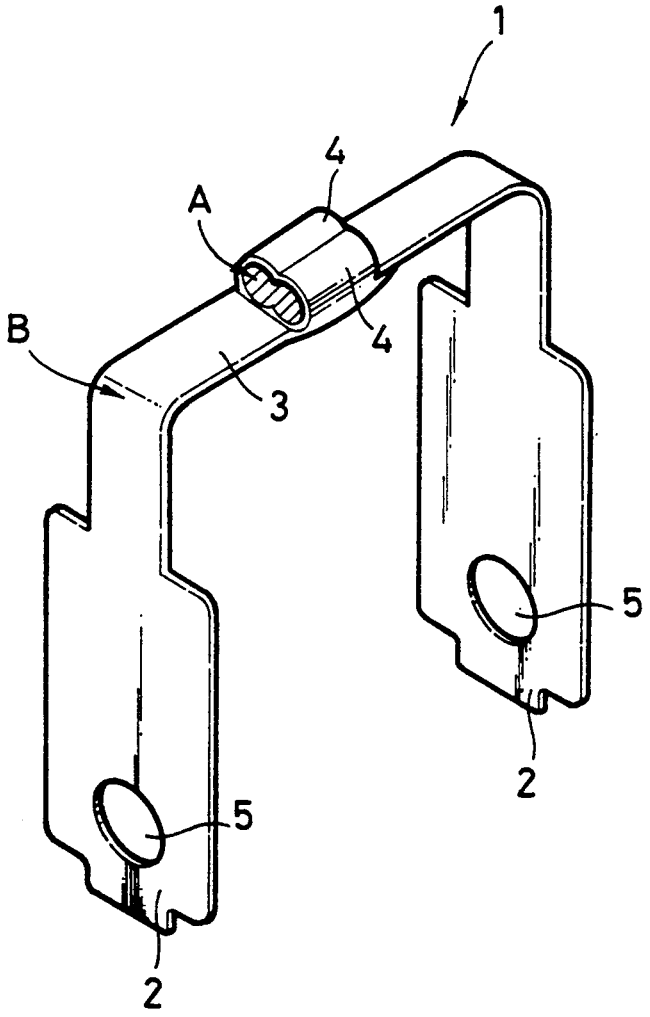
FIG. 1 is a perspective view of a fuse which is an embodiment of the present invention.

FIG. 1 is a perspective view of a fuse 1 as Example 1 according to the present invention. As shown in the same drawing, fuse 1 comprises a linear low-melting-point metal chip A and a meltable and conductive metal element B.

Further, the chip A comprises a set of several pieces of metal materials obtained by extrusion molding. The element B has a meltable portion 3 whose area (e.g., 0.3 $mm^2$ or so) is smaller than the sectional area of a wire to be used for connection. Moreover, the meltable portion 3 has a pair of planar terminals 2, 2 extending vertically to the portion 3 at both the ends thereof. In addition, each of terminals 2, 2 is provided with a hole 5 for attachment to a junction block or connector housing. Incidentally, chip A is mounted on the meltable portion 3 of element B, and is fixed by caulking with ear-like portions 4, 4 integrally projecting on both sides of the portion 3.

When the fuse 1 is used, holes 5, 5 of both terminals 2, 2 are attached to a connector housing or the like element, respectively. If an overcurrent flows through the fuse 1, the meltable portion 3 of element B is melted and the circuit opens.

The material of element B is an alloy whose matrix is copper (Cu) which is the same as the material of wiring. Namely, element B comprises a Cu alloy slightly containing Fe, P and the like component. However, it should be noted that the content of Fe or P is so low as to maintain normal blowout properties under the overcurrent condition.

In this case, chip A has the following composition corresponding to a kind of solder alloy.

Cu: 0.5 to 3.5% by weight

Sn: All of the residual content

If the content of Cu in the chip is less than 0.5% by weight, the durability of fuse 1 becomes deteriorated in the medium current range. Contrary, if it exceeds 3.5% by weight, Cu separates out from the surface of chip A, thus the fuse can not be applied to practical use.

Namely, since chip A comprises a Sn-Cu alloy, diffusion of Cu from the meltable portion 3 of element B to chip A is suppressed under a temperature condition lower than 300° C. which corresponds to the medium current range, thereby to enhance the durability of fuse 1.

Figure 2:
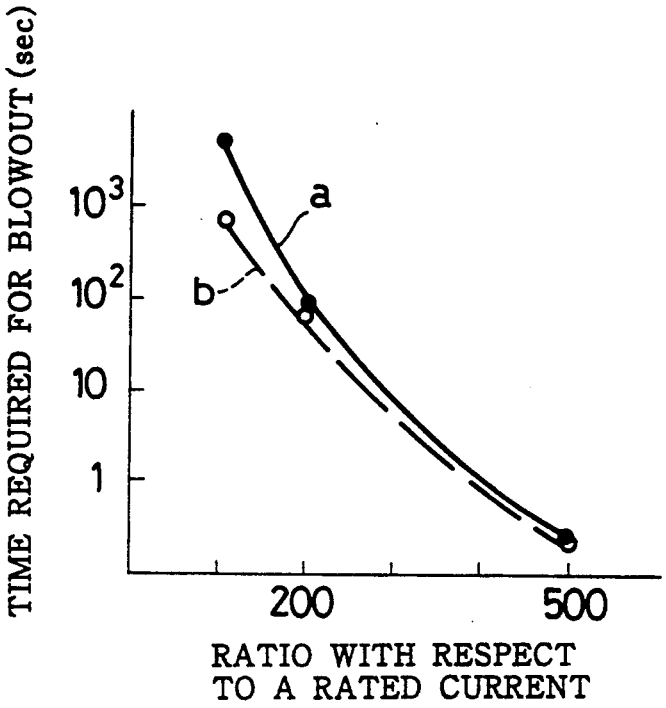
FIG. 2 is a diagram for comparing blowout properties between Example 1 according to the present invention and Comparative Example.

FIG. 2 is a diagram showing the blowout properties of the fuse. In the same drawing, the transverse axis shows ratio with respect to a rated current, and the vertical axis shows time (sec) required for blowout. Moreover, solid line a denotes Example 1, and dotted line b designates Comparative Example as a conventional fuse. As seen from the same diagram, in the medium current range, the time required for blowout in Example 1 becomes slightly longer than that in Comparative Example because the melting point of this embodiment is elevated. However, in the range of current around the ratio of 500%, the blowout properties of both Example 1 and Comparative Example are almost the same.

Figure 3:
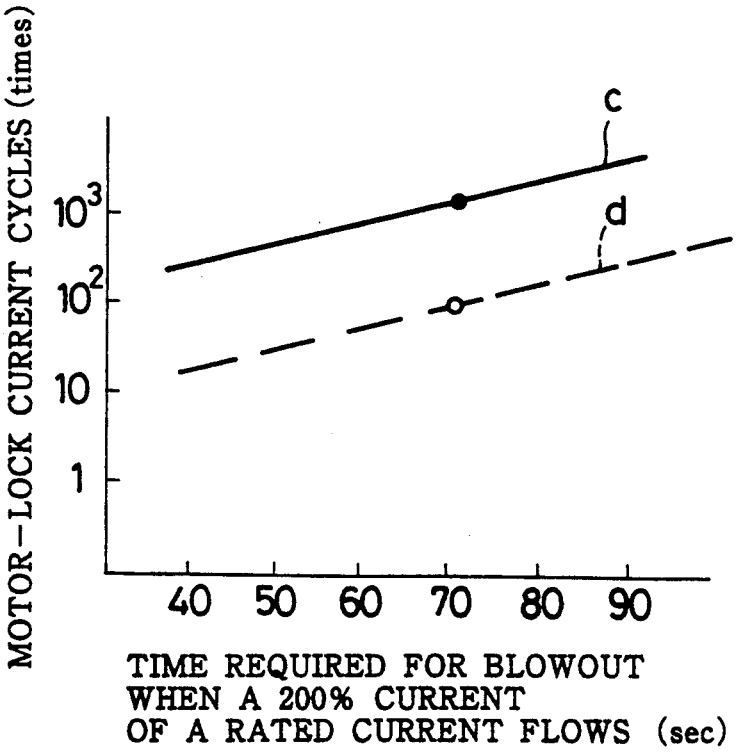
FIG. 3 is a diagram for comparing durabilities with respect to the number of motor-lock current cycles between Example 1 and Comparative Example.

Nevertheless, as shown in FIG. 3, the durability of this embodiment (Example 1) is far improved as compared with Comparative Example. Incidentally, the transverse axis of FIG. 3 shows time (sec) required for blowout when a 200% current with respect to the rated current flows through the fuse. On the other hand, the vertical axis of the same drawing shows the number of motor-lock current cycles at an interval of 10 seconds. Moreover, solid line c denotes this embodiment, and dotted line d designates Comparative Example. As is understood from FIG. 3, this embodiment inceases about 10 times the number of cycles required for blowout in Comparative Example. Accordingly, it is obvious that the durability of Example 1 is far improved.

EXAMPLE 2

The fuse as Example 2 according to the present invention also has the same construction as that of Example 1 shown in FIG. 1. Therefore, the same reference numerals or parts as those described in Example 1 are not explained here.

In this embodiment, chip A has the following composition corresponding to a kind of solder alloy.

Cu: 0.5 to 3.5% by weight

Sb: 1.0 to 6.0% by weight

Sn: All of the residual content

If the content of Sb (antimony) is higher than 6.0% by weight, the alloy is hardened, so that the extrusion molding becomes difficult. Conversely, if it is less than 1.0% by weight, the durability in the medium current range is deteriorated.

In addition, if the content of Cu is less than 0.5% by weight, the durability of fuse becomes impaired in the medium current range. Contrary, if it exceeds 3.5% by weight, Cu separates out from the surface of chip A, thus the fuse can not be applied to practical use.

Generally, a solder alloy is hardened by addition of Sb, thus its processability is degraded. However, this embodiment is also softened by addition of Cu to enhance the extrusion moldability. Moreover, the time required for blowout in this case is increased by effect of both Sb and Cu, thereby to enhance the durability in the medium current range.

Figure 4:
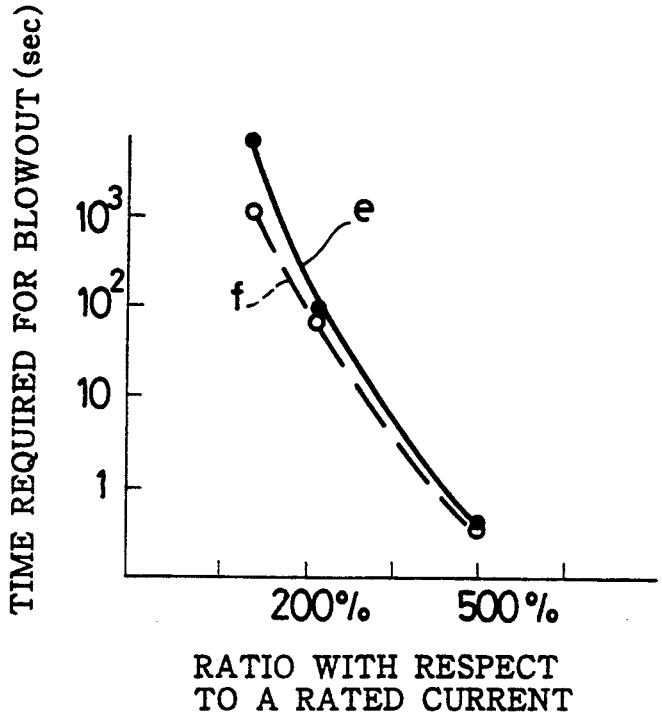
FIG. 4 is a diagram for comparing blowout properties between Example 2 according to the present invention and Comparative Example.

FIG. 4 is a diagram for the same purpose as of FIG. 2. In the same drawing, solid line e denotes this embodiment (Example 2), and dotted line f designates Comparative Example as a conventional fuse. As seen from FIG. 4, in the medium current range, the time required for blowout in Example 2 becomes slightly longer than that in Comparative Example. However, in the range of current around the ratio of 500%, the blowout properties of both Example 2 and Comparative Example are almost the same.

Figure 5:
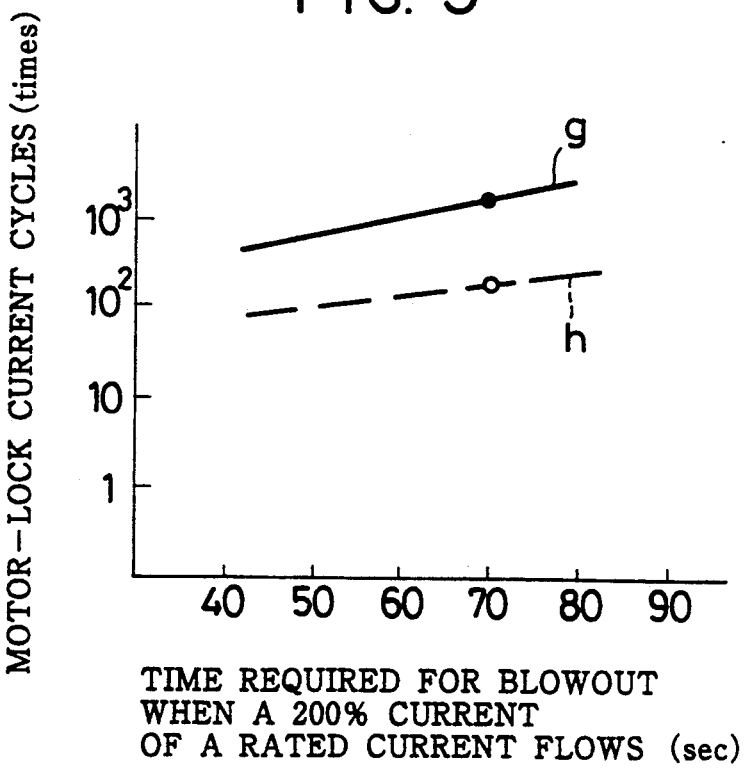
FIG. 5 is a diagram for comparing durabilities with respect to the number of motor-lock current cycles between Example 2 and Comparative Example.

Further, FIG. 5 is a diagram for the same purpose as of FIG. 3. In the same drawing, solid line g denotes this embodiment, and dotted line h designates Comparative Example. As is understood from FIG. 5, this embodiment inceases about 10 times the number of cycles required for blowout in Comparative Example. Accordingly, the durability of this embodiment is obviously improved.

Various modifications will become possible for those skilled in the art after receiving the teachings of the present disclosure without departing from the scope thereof.

What is claimed is:

1. A fuse, comprising:

a meltable and conductive metal element mainly containing Cu and including a blowout portion; and a low-melting-point metal chip fixed at said blowout portion; wherein said low-melting-point metal chip comprises a Sn-Cu alloy.

2. A fuse according to claim 1, wherein said low-melting-point metal chip comprises an alloy containing 0.5 to 3.5% by weight of Cu and all the residual content of Sn.

3. A fuse according to claim 1, wherein said low-melting-point metal chip comprises an alloy containing 0.5 to 3.5% by weight of Cu, 1.0 to 6.0% by weight of Sb and all the residual content of Sn.

4. A fuse, comprising:

a meltable and conductive metal element mainly containing copper and including a blowout portion; and a low-melting-point metal chip positioned at said blowout portion, said chip comprising an alloy containing from about 0.5 to about 3.5 percent by weight of copper, from about 1.0 to about 6.0 percent by weight of antimony, and the remainder being primarily of tin.

* * * * *